US011108187B2

(12) United States Patent
Starke et al.

(10) Patent No.: US 11,108,187 B2
(45) Date of Patent: Aug. 31, 2021

(54) CONNECTOR PART WITH A SHIELDING SLEEVE

(71) Applicant: Phoenix Contact GmbH & Co. KG, Blomberg (DE)

(72) Inventors: Cord Starke, Blomberg (DE); Kathrin Dober, Lemgo (DE); Daniel Nolting, Hiddenhausen (DE)

(73) Assignee: PHOENIX CONTACT GMBH & CO. KG, Blomberg (DE)

( * ) Notice: Subject to any disclaimer, the term of this patent is extended or adjusted under 35 U.S.C. 154(b) by 0 days.

(21) Appl. No.: 17/043,765

(22) PCT Filed: Mar. 22, 2019

(86) PCT No.: PCT/EP2019/057212
§ 371 (c)(1),
(2) Date: Sep. 30, 2020

(87) PCT Pub. No.: WO2019/206536
PCT Pub. Date: Oct. 21, 2019

(65) Prior Publication Data

US 2021/0036456 A1 Feb. 4, 2021

(30) Foreign Application Priority Data

Apr. 23, 2018 (BE) ..... 2018/5270

(51) Int. Cl.
*H01R 13/504* (2006.01)
*H01R 13/52* (2006.01)
(Continued)

(52) U.S. Cl.
CPC ..... *H01R 13/504* (2013.01); *H01R 13/5202* (2013.01); *H01R 13/6591* (2013.01); *H01R 43/24* (2013.01); *H01R 13/5845* (2013.01)

(58) Field of Classification Search
CPC ..... H01R 13/504; H01R 13/5202; H01R 13/5845; H01R 13/6591; H01R 43/24
See application file for complete search history.

(56) References Cited

U.S. PATENT DOCUMENTS 5,658,171 A * 8/1997 Pauza ..... H01R 13/5202 439/675
2010/0184318 A1 7/2010 Bogart et al.
(Continued)

FOREIGN PATENT DOCUMENTS

DE 102010036324 A1 1/2012
DE 102013205493 A1 10/2013
EP 2112721 A1 10/2009

*Primary Examiner* — Oscar C Jimenez
(74) *Attorney, Agent, or Firm* — Leydig, Voit & Mayer, Ltd.

(57) ABSTRACT

A connector part includes: an electrically conductive shield sleeve; a plug-in portion provided on the shield sleeve for plug-in connection to an associated mating connector part; at least one electrical contact element disposed in or on the plug-in portion; a plastic housing part at least partially enclosing the shield sleeve; a pressure element which is disposed on the shield sleeve and connected to the plastic housing part and which has a receiving means; and a sealing element which is disposed in the receiving means of the pressure element and in sealing engagement with the shield sleeve to seal a transition between the plastic housing part and the shield sleeve.

16 Claims, 7 Drawing Sheets

(51) Int. Cl.

| | |
|---|---|
| ***H01R 13/6591*** | (2011.01) |
| ***H01R 43/24*** | (2006.01) |
| ***H01R 13/58*** | (2006.01) |

(56) References Cited

U.S. PATENT DOCUMENTS

| | | | |
|---|---|---|---|
| 2013/0260585 | A1 | 10/2013 | Wang |
| 2015/0332809 | A1 | 11/2015 | Wild et al. |

* cited by examiner

CONNECTOR PART WITH A SHIELDING SLEEVE

CROSS-REFERENCE TO PRIOR APPLICATIONS

This application is a U.S. National Phase application under 35 U.S.C. § 371 of International Application No. PCT/EP2019/057212, filed on Mar. 22, 2019, and claims benefit to Belgian Patent Application No. BE 2018/5270, filed on Apr. 23, 2018. The International Application was published in German on Oct. 31, 2019 as WO 2019/206536 under PCT Article 21(2).

FIELD

The invention relates to a connector part and to a method for manufacturing a connector part.

BACKGROUND

Such a connector part includes an electrically conductive shield sleeve, a plug-in portion provided on the shield sleeve for plug-in connection to an associated mating connector part, at least one electrical contact element disposed in or on the plug-in portion, and a plastic housing part at least partially enclosing the shield sleeve.

Such a connector part may, for example, be configured as what is known as a circular connector, where the plug-in portion has a substantially cylindrical shape and can be brought into contact with a correspondingly shaped, complementary mating connector part. Such a circular connector can be advantageously used, for example, for data, sensor signal and power transmission in an industrial environment.

The shield sleeve is made from an electrically conductive material and serves, in particular, to provide shielding of signals transmitted through the connector part. The plastic housing part may be formed directly on the shield sleeve, for example by overmolding, and thus partially encloses the shield sleeve in such a manner that wires of an electrical cable connected to the connector part are fixed relative to the shield sleeve and thereby fixedly secured to the connector part. Such an overmolded plastic housing part may enclose, for example, not only the shield sleeve, but also, for example, a connection region for stranded cores of electrical wires inside the connector, so that contact elements of the connector part are not floatingly supported within the connector part, but held in position by the plastic housing part.

Generally, it is desirable that such a connector part comply with a predefined degree of protection and for this purpose be sufficiently moisture-proof. To this end, it is necessary to seal a transition between the plastic housing part and the shield sleeve in order to prevent the ingress of moisture into the interior of the connector part through a capillary gap that may be present between the plastic housing part and the shield sleeve. If the plastic housing part is formed on the shield sleeve by overmolding, such sealing can sometimes be difficult to achieve.

DE 10 2010 036 324 A1 describes a cable and an injection-molded part disposed thereon. The injection-molded part is sealed via a sealing element against the cable.

In a connector known from DE 10 2013 205 493 A1, a shield is sealed against a conductor.

SUMMARY

In an embodiment, the present invention provides a connector part, comprising: an electrically conductive shield sleeve; a plug-in portion provided on the shield sleeve for plug-in connection to an associated mating connector part; at least one electrical contact element disposed in or on the plug-in portion; a plastic housing part at least partially enclosing the shield sleeve; a pressure element which is disposed on the shield sleeve and connected to the plastic housing part and which has a receiving means; and a sealing element which is disposed in the receiving means of the pressure element and in sealing engagement with the shield sleeve to seal a transition between the plastic housing part and the shield sleeve.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
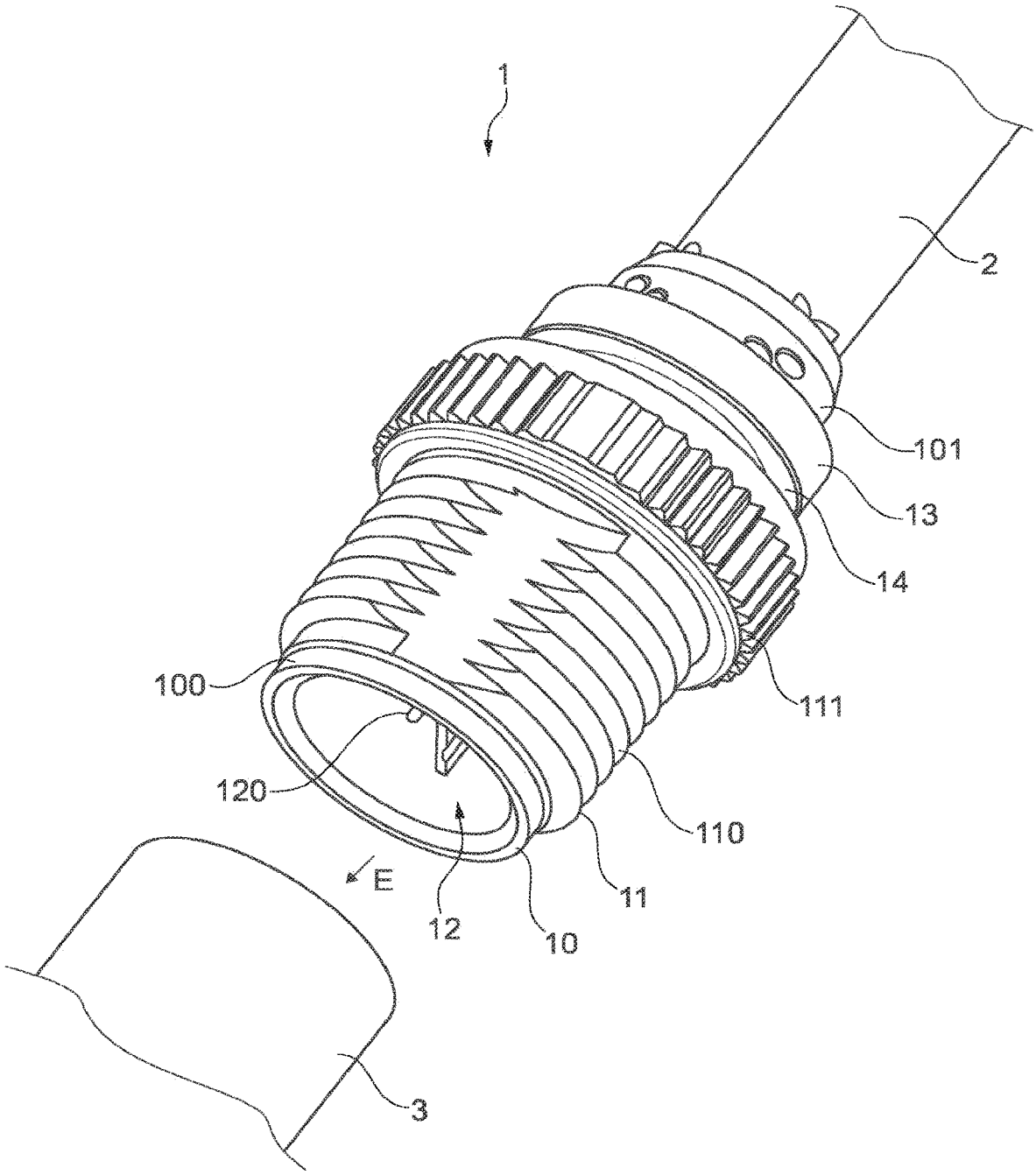
FIG. 1 is a view of an exemplary embodiment of a connector part in the form of a circular connector.

In an embodiment, the present invention provides a connector part and a method for manufacturing a connector part which will permit reliable sealing of the plastic housing part against the shield sleeve and at the same time allow for a simple construction and easy manufacture.

Accordingly, the connector part includes a pressure element which is disposed on the shield sleeve and connected to the plastic housing part and which has a receiving means, and further includes a sealing element which is disposed in the receiving means of the pressure element and in sealing engagement with the shield sleeve to seal a transition between the plastic housing part and the shield sleeve.

The plastic housing part may be formed, for example, by overmolding a portion of the shield sleeve. Thus, the plastic housing part is formed on the shield sleeve by overmolding.

In order to enable sealing of a transition between the plastic housing part and the shield sleeve, a sealing assembly formed by the pressure element and the sealing element is used, the sealing assembly being disposed on the shield sleeve and connected to the plastic housing part. The sealing element serves to seal the transition between the plastic housing part and the shield sleeve and sealingly engages against the shield sleeve. The pressure element preloads the sealing element by pressing it against the shield sleeve and thereby compressing the sealing element, so that a seal is provided by the pressing engagement of the sealing element with the shield sleeve. The compression of the sealing element for sealing against the shield sleeve is effected by the pressure element in that the sealing element is held on and pressed against the shield sleeve by the pressure element (which is separate from the plastic housing part but connected thereto, for example by areal engagement therewith or by a material-to-material bond). Thus, the sealing effect of the sealing element is independent of the plastic housing part, in particular of any action of the plastic housing part on the sealing element. This makes it possible to effect an advantageous sealing action via the pressure element in order to then form the plastic housing part on the shield sleeve, for example by overmolding.

The pressure element is connected to the plastic housing part. In one embodiment, this may be achieved by the pressure element forming a bond with the plastic housing part, for example by being connected to the plastic housing part by a material-to-material bond or by an interference fit or interlocking fit.

A material-to-material bond between the pressure element and the plastic housing part can be created, for example, when during the overmolding of the shield sleeve with the material of the plastic housing part, the plastic housing part is also molded against the pressure element (which at this point has already been placed on the shield sleeve), so that such molding creates a material-to-material bond between the pressure element and the plastic housing part.

In one embodiment, during the formation of the plastic housing part on the shield sleeve, the pressure element may also be overmolded, so that the pressure element is completely or partially enclosed by the plastic housing part. In this case, the plastic housing part covers the assembly formed by the pressure element and the sealing element on the outside, thus enclosing the pressure element and the sealing element.

However, in another embodiment, it is also conceivable and possible that the plastic housing part may be molded against an end face of a body of the pressure element and may thus form a bond with the pressure element over a planar surface area thereof.

In yet another embodiment, it conceivable and possible that while the plastic housing part is, in fact, in engagement with the pressure element, no material-to-material bond exists between the plastic housing part and the pressure element. In this case, the pressure element may engage a latching groove of the shield sleeve and thereby be held in position on the shield sleeve in such a manner that the pressure element is in contact with the plastic housing part and connected to the plastic housing part in this way.

In an embodiment, the shield sleeve has a stem portion formed at an end opposite the plug-in portion of the shield sleeve. The shield sleeve may have, for example, a cylindrical basic shape, especially if the connector part is designed as a circular connector, and accordingly, the stem portion of the shield sleeve and the plug-in portion may also be cylindrical in shape. The plastic housing part is formed on the stem portion, for example by the stem portion being at least partially overmolded with the material of the plastic housing part.

In one embodiment, the pressure element is annular in shape and disposed on the stem portion of the shield sleeve in such a manner that the pressure element extends around the stem portion. In this case, the pressure element is configured as an annular element and placed on the (in particular cylindrical) stem portion of the shield sleeve, so that the stem portion extends through the pressure element. The pressure element may be held in position on the shield sleeve by engagement in a latching groove of the shield sleeve, which facilitates fitting of the pressure element on the shield sleeve together with the sealing element, and also allows the pressure element and the sealing element to be precisely fixed in position relative to the shield sleeve.

If the pressure element is configured as an annular element, the latching groove preferably extends circumferentially around the shield sleeve (for example around the stem portion on which the pressure element is disposed), and thus holds the pressure element positively in position on the shield sleeve.

If the pressure element is configured as an annular element, the sealing element is preferably also annular in shape and formed, for example, in the manner of an O-ring. The sealing element is received in the receiving means of the pressure element and extends circumferentially in the receiving means. The sealing element is disposed on the stem portion of the shield sleeve in such a manner that the stem portion extends through the sealing element and is, at the same time, in pressing and sealing engagement with the sealing element. In an embodiment, the pressure element has a body which is in engagement with the shield sleeve via an engagement surface. The body may, for example, engage the latching groove in the stem portion of the shield sleeve, so that the pressure element is thereby fixedly and positively secured on the stem portion. Engagement between the pressure element and the stem portion is provided via the engagement surface.

The sealing element is preferably configured such that, in an initial condition before the assembly formed by the pressure element and the sealing element is placed on the shield sleeve, the sealing element projects beyond the engagement surface of the body of the pressure element. As the pressure element is placed on the shield sleeve, together with the sealing element, the sealing element is compressed by interaction with the shield sleeve, thus causing the sealing element to pressingly engage against the shield sleeve for reliable, moisture-tight sealing of a transition between the plastic housing part and the shield sleeve.

In one embodiment, the receiving means forms an undercut for receiving the sealing element. The sealing element is received and positively held in the receiving means by the undercut configuration thereof and is thereby prevented from slipping axially out of place. Thus, the sealing element cannot readily slip out of the receiving means axially relative to the shield sleeve, in particular axially relative to the (cylindrical) stem portion on which the pressure element is disposed together with the sealing element, so that the sealing element is held in position relative to the pressure element.

In one embodiment, the sealing element is made as an element separate from the pressure element and is inserted in the receiving means of the pressure element. In this case, the sealing element may, for example, take the form of an O-ring and is received in the receiving means in such a manner that in the mounted position, the sealing element is held by the pressure element in compressed, pressing engagement with the shield sleeve.

The pressure element may, for example, be made from a relatively hard plastic, for example a thermoplastic material. In contrast, the sealing element is made from a relatively soft material, for example a rubber material or a soft plastic material, such as an elastomer, and thus is compressible for reliable sealing engagement with the shield sleeve.

In another embodiment, the pressure element and the sealing element may be manufactured by plastic injection molding using a two-component injection molding technique. In this embodiment, the sealing element is not separate from the pressure element after completion of the manufacturing process, but is manufactured together with the pressure element by plastic injection molding. In this case, the pressure element is formed by a relatively hard plastic component, for example a thermoplastic material, while the sealing element is composed of a soft component, such as an elastomer.

In one embodiment, the sealing element has a bead portion which is received in the receiving means of the pressure element. If the sealing element is configured an annular element, the bead portion, which is, for example, circular or oval in cross section, extends, for example, around the stem portion of the shield sleeve. Via the bead portion, the sealing element is preferably in sealing engagement with the shield sleeve.

In one embodiment, a planar portion extends from the bead portion substantially perpendicularly to the outer surface of the stem portion, the planar portion bearing, for example, against an end face of the pressure element. The planar portion may, for example, extend to the outer peripheral surface of the body of the pressure element, which may facilitate the production, in particular the injection molding of the sealing element when manufactured using a two-component injection molding technique.

In an embodiment the present invention provides a method for manufacturing a connector part of the type described hereinabove. In such method, the pressure element is placed on the shield sleeve together with the sealing element, and the plastic housing part is formed on the shield sleeve by overmolding.

The advantages and advantageous embodiments described above are analogously applicable to the method.

FIGS. 1 through 3A, 3B show an exemplary embodiment of a connector part 1 in the form of a circular connector, which can be connected to an associated mating connector part 3 along a plugging direction E. Connector part 1 has a shield sleeve 10 on which is disposed a threaded element 11 for connecting and fixing connector part 1 to mating connector part 3. Threaded element 11 can be rotated on shield sleeve 10 to thereby create a firm, heavy-duty, and vibration-resistant connection between connector part 1 and mating connector part 3.

Shield sleeve 10 is made from an electrically conductive material, in particular a metal material, and is formed with a plug-in portion 100 which encloses a connector face 12 having a plurality of electrical contact elements 120. Via plug-in portion 100, connector part 1 can be pluggingly connected to mating connector part 3 along plugging direction E to thereby create an electrical connection between connector part 1 and mating connector part 3.

Connector part 1 is connected to an electrical cable 2 which has a plurality of wires electrically contacted to the contact elements 120 and which is inserted into the interior of connector part 1 via a cylindrical stem portion 101 of shield sleeve 10 at an end opposite the plug-in portion 100.

Figure 2A:
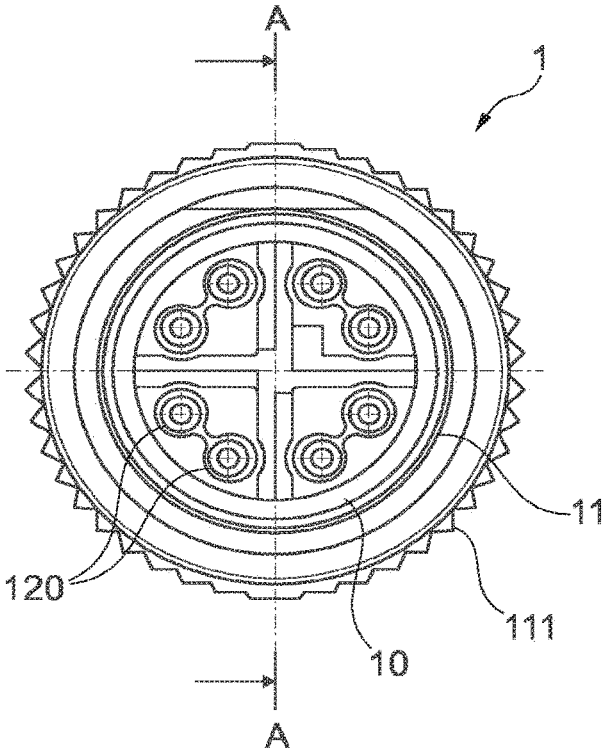
FIG. 2A is a frontal view of the connector part.
Figure 2B:
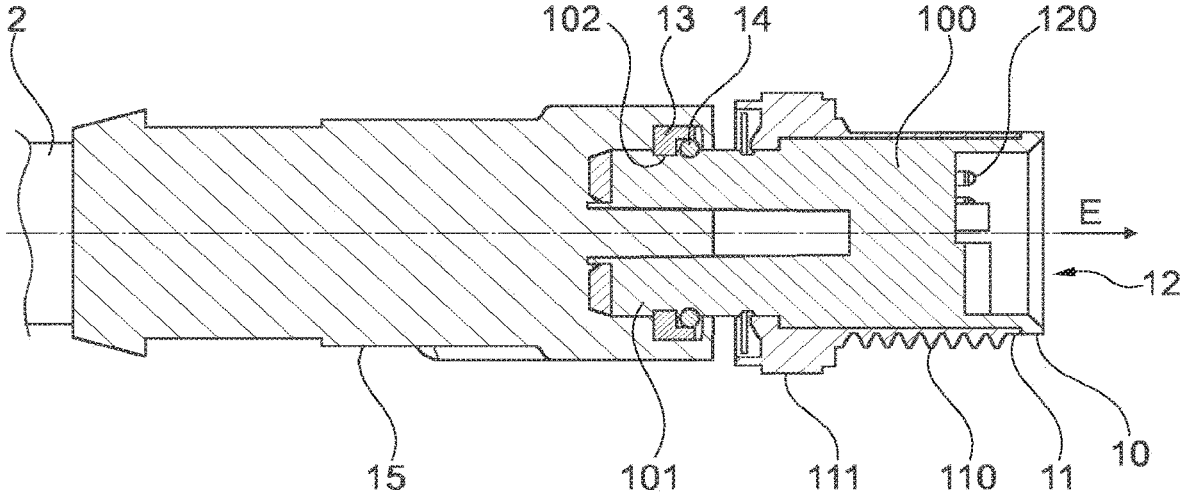
FIG. 2B is a sectional view taken along line A-A in FIG. 2A.

As can be seen from FIG. 2B, a plastic housing part 15 is disposed on shield sleeve 10 (namely on stem portion 101 of shield sleeve 10, opposite the plug-in portion 100) and encloses the stem portion 101 and the electrical wires of cable 2 inserted into stem portion 101 along a certain length thereof, thereby fixing the electrical wires relative to shield sleeve 10. Plastic housing part 15 is overmolded onto stem portion 101 of shield sleeve 10 by plastic injection molding, and thus forms a permanent bond with shield sleeve 10.

Connector part 1, embodied as the circular connector, is used for data, signal and/or power transmission and, in particular, allows for a reliable, vibration-resistant, heavy-duty connection between an electrical cable 2 and an associated electrical unit. It is desirable for connector part 1 to comply with a predefined degree of protection, which in particular also requires a sufficient degree of moisture proofness. In particular, it is desired to prevent the ingress of moisture into the interior of connector part 1 in order to prevent impairment of an electrical connection.

To achieve this, it is in particular required to seal a transition between plastic housing part 15 and shield sleeve 10. For this reason, connector part 1 has a sealing assembly which is formed by a pressure element 13 and a sealing element 14 and which is placed on stem portion 101 of shield sleeve 10 and serves to prevent the ingress of moisture through a capillary gap between plastic housing part 15 and shield sleeve 10, particularly stem portion 101.

Figure 3A:
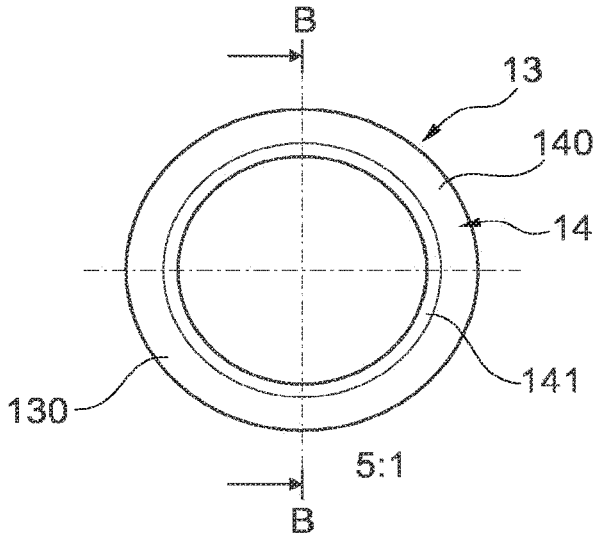
FIG. 3A is a frontal view of an assembly formed by a pressure element and a sealing element for sealing of a transition between a plastic housing part and a shield sleeve of the connector part.
Figure 3B:
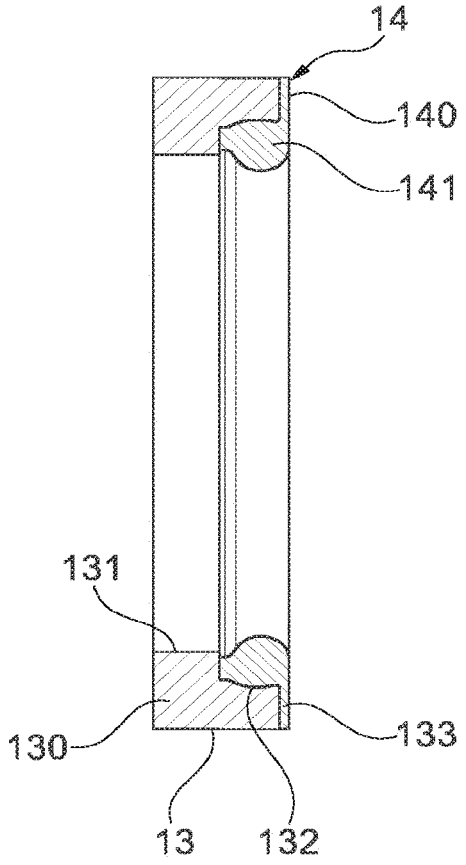
FIG. 3B is a sectional view taken along line B-B in FIG. 3A.
Figure 4:
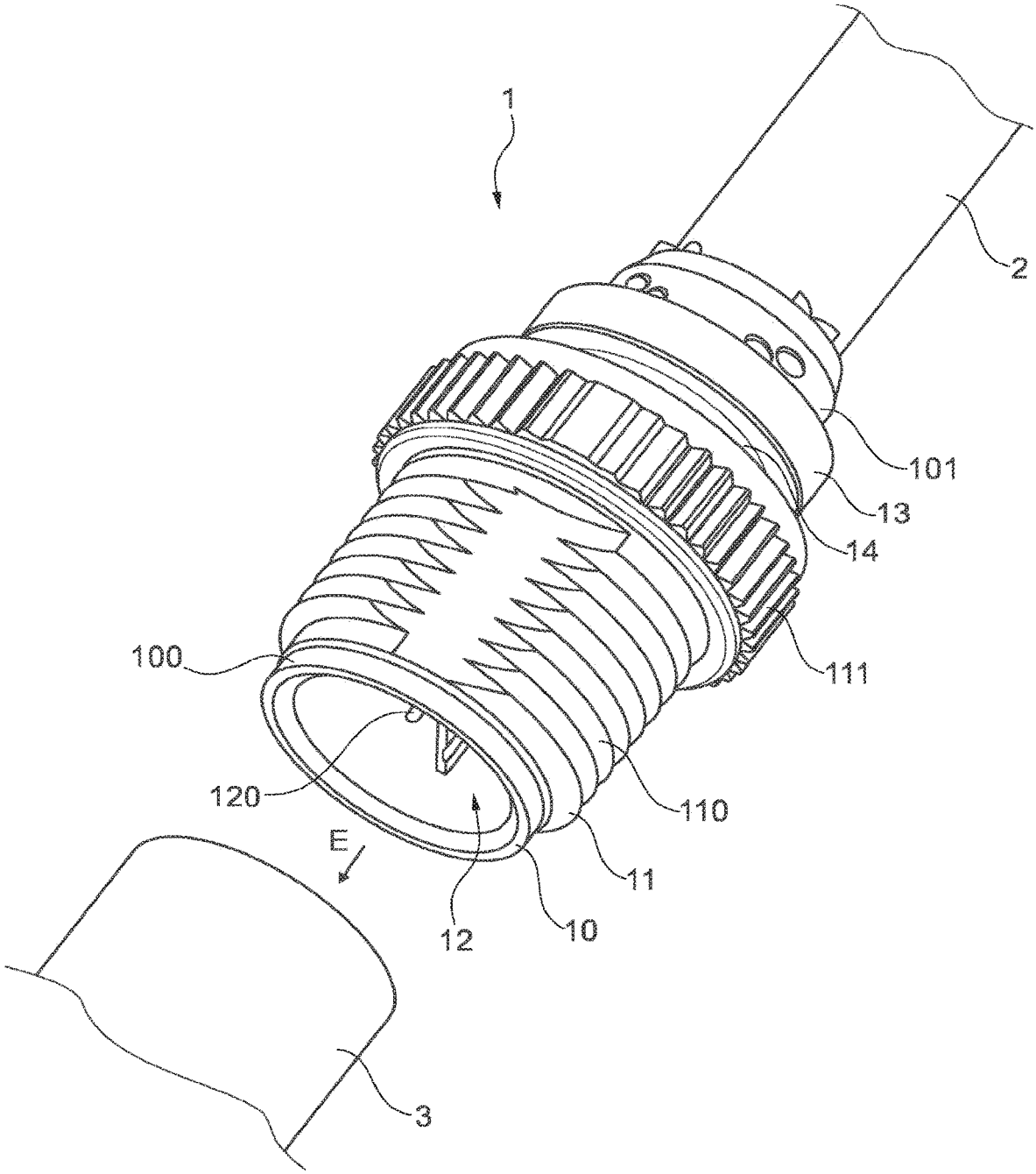
FIG. 4 is a view of another exemplary embodiment of a connector part in the form of a circular connector.
Figure 5A:
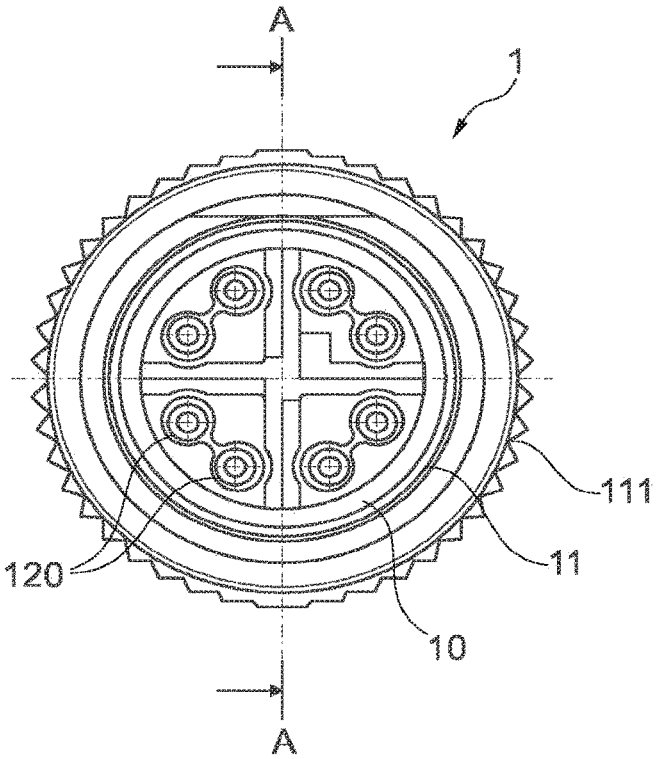
FIG. 5A is a frontal view of the connector part of FIG. 4.
Figure 5B:
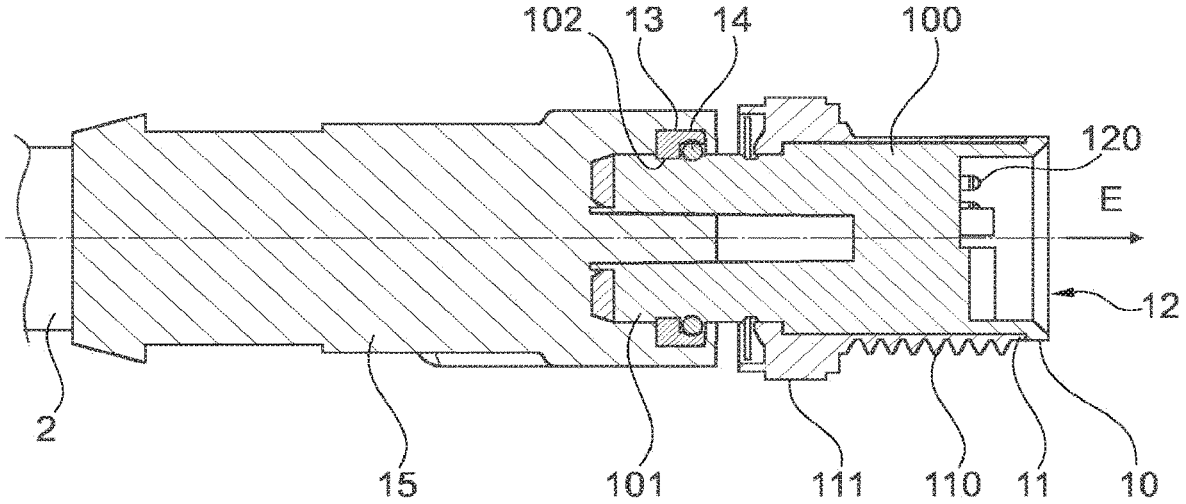
FIG. 5B is a sectional view taken along line A-A in FIG. 5A.

Pressure element 13 is configured as an annular element and, as seen in the views of FIGS. 3A, 3B, has a body 130 which is in engagement with stem portion 101 via an engagement surface 131. In the region of engagement surface 131, body 130 engages a latching groove 102 (see FIG. 2B) in the outer peripheral surface of stem portion 101, so that pressure element 13 is thereby positively fixed on stem portion 101 and, in particular, prevented from slipping axially on the stem portion 101.

Body 130 has a receiving means 132 in the form of an annular recess formed therein to receive sealing element 14. Receiving means 132 forms an undercut which is in the form of a concave depression and which causes sealing element 14 to be positively held in receiving means 132 and, in particular, prevents it from slipping out of receiving means 13 axially along stem portion 101.

In the exemplary embodiment shown, the assembly formed by pressure element 13 and sealing element 14 is manufactured by plastic injection molding using a two-component injection molding technique. Thus, the assembly is produced in an injection mold using two different plastic components, namely a hard component for forming pressure element 13 and a soft component for forming sealing element 14. The hard component used may, for example, be a thermoplastic material. The soft component may, for example, be an elastomer. As can be seen from the sectional view of FIG. 3A, sealing element 14 has an annular circumferential bead portion 141 with which sealing element 14 rests in receiving means 132 of pressure element 13. An annular circumferential planar portion 140 extends from bead portion 141 to an outer peripheral surface of body 130 and bears against an end face 133 of pressure element 13, so that end face 133 of pressure element 13 is covered by planar portion 140. Such a design of the sealing element 14 may, in particular, allow easy manufacture by molding sealing element 14 against pressure element 13 in an injection mold.

For assembly, in one step, the assembly formed by pressure element 13 and sealing element 14 is placed on stem portion 101 of shield sleeve 10 until pressure element 13 engages the latching groove 102 formed on stem portion 101. In an initial state, as can be seen from the sectional view of FIG. 3B, bead portion 141 of sealing element 14 projects radially inwardly beyond engagement surface 131 of pressure element 13, and therefore sealing element 14 is compressed in the region of its bead portion 141 as pressure element 13 and sealing element 14 are placed on stem portion 101, and thus comes into pressing, sealing engagement with the outer peripheral surface of the stem portion 101. Sealing element 14 thus seals against stem portion 101.

Then, with electrical cable 2 connected to connector part 1, plastic housing part 15 is formed directly on shield sleeve 10 by overmolding electrical cable 2 and stem portion 101 at least partially with the material of plastic housing part 15, thereby fixing electrical cable 2 on shield sleeve 10.

As can be seen from the sectional view of FIG. 2B, the assembly formed by pressure element 13 and sealing element 14 is also overmolded with the material of the plastic housing part 15 in this process, so that plastic housing part 15 forms a bond with pressure element 13, and thus the assembly formed by pressure element 13 and sealing element 14 is fixed relative to plastic housing part 15.

Since sealing element 14 extends annularly around stem portion 101, a transition between plastic housing part 15 and stem portion 101 is sealed moisture-tight in this way. In particular, it is no longer possible for moisture to bypass sealing element 14 and enter the interior of the connector part through a capillary gap between plastic housing part 15 and stem portion 101.

Figure 6A:
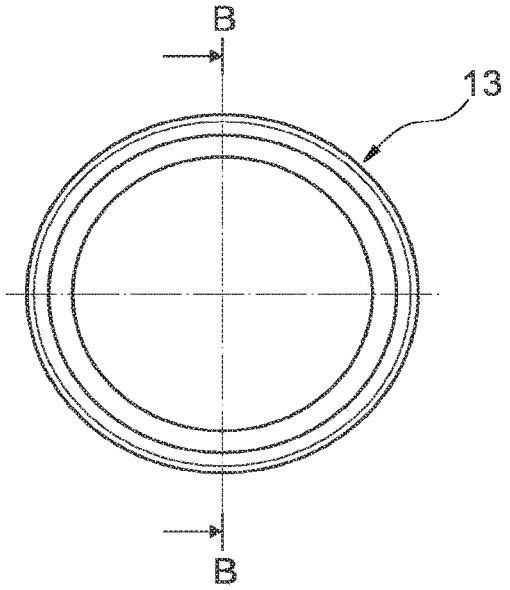
FIG. 6A is a separate view of a pressure element of this exemplary embodiment.
Figure 6B:
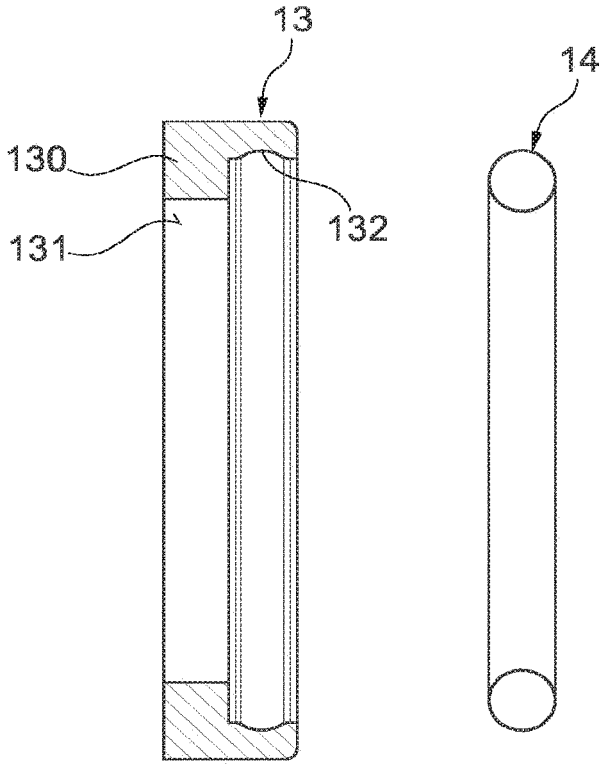
FIG. 6B is a sectional view taken along line B-B in FIG. 6A and showing the pressure element together with a sealing element.

In the exemplary embodiment illustrated in FIGS. 4 through 6A, 6B, a sealing element 14 is configured as an annular element in the form of an O-ring separate from pressure element 13, as can be seen in particular from FIG. 6B. In this case, sealing element 14 is inserted in a receiving means 132 of pressure element 13 and is positively held in receiving means 132 by means of an undercut formed in receiving means 132 (in the form of a concave depression in the region of receiving means 132).

In this case, pressure element 13 is manufactured as a plastic part by injection molding from a relatively hard plastic, in particular a thermoplastic material.

For assembly, again, the assembly formed by pressure element 13 and sealing element 14 is placed on stem portion 101 of shield sleeve 10 (which is identical in design to the exemplary embodiment shown in FIGS. 1 through 3A, 3B), in order to then overmold stem portion 101, along with an electrical cable 2 connected to connector part 1, with the material of plastic housing part 15, thereby forming the plastic housing part 15 on shield sleeve 10. As can be seen from the sectional view of FIG. 5B, the assembly formed by pressure element 13 and sealing element 14 is also overmolded in this process, so that the assembly is fixed on shield sleeve 10, and a transition between plastic housing part 15 and stem portion 101 is sealed moisture-tight by sealing element 14.

Figure 7:
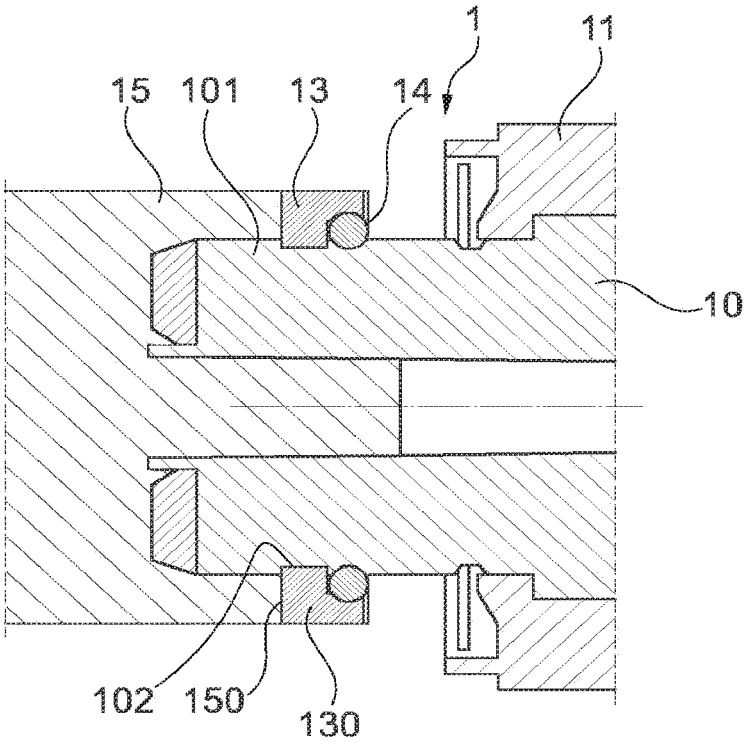
FIG. 7 is a sectional view of another exemplary embodiment of a connector part.
Figure 8:
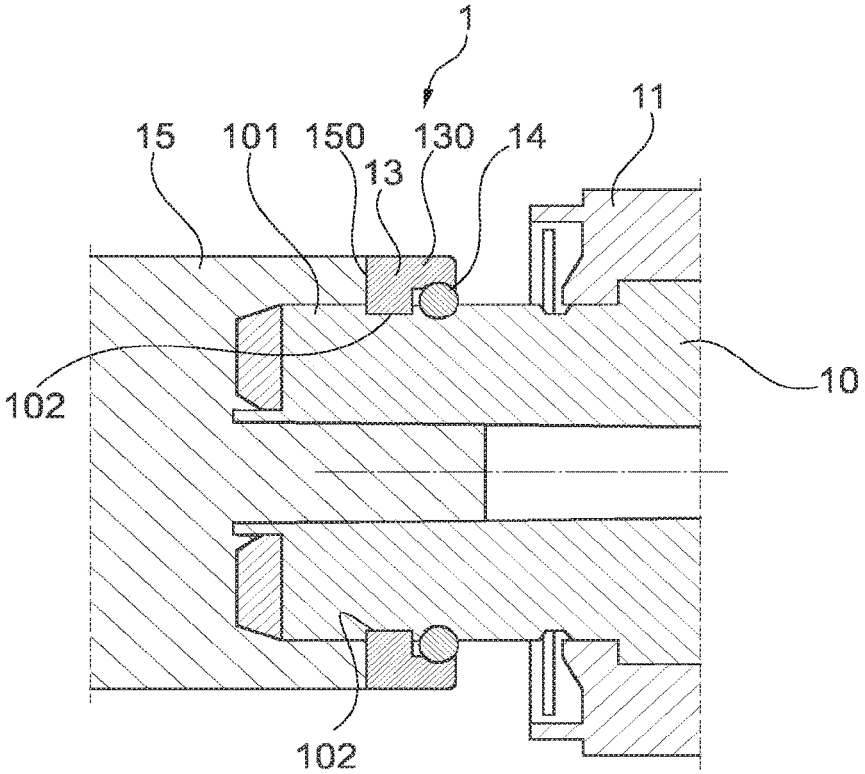
FIG. 8 is a sectional view of yet another exemplary embodiment of a connector part.

FIG. 7 shows an exemplary embodiment which is modified over that in FIGS. 1 through 3A, 3B in that, after stem portion 101 of shield sleeve 10 is overmolded, plastic housing part 15 does not completely enclose pressure element 13 outwardly, but terminates at a rear end face 150 of pressure element 13, opposite the plug-in portion 100. In this case, too, the material of plastic housing part 15 preferably forms a (material-to-material) bond with pressure element 13 during molding, so that a connection is created between plastic housing part 15 and pressure element 13. Analogously, FIG. 8 shows a modification of the exemplary embodiment of FIGS. 4 through 6A, 6B. Again, the material of plastic housing part 15 does not completely enclose pressure element 13 outwardly, but terminates at and flush with a rear end face 150 of pressure element 13.

In the exemplary embodiments shown in FIGS. 7 and 8, pressure element 13 can also be used as a seal for an injection mold during the overmolding of stem portion 101 of shield sleeve 10. In this case, the injection mold may, for example, bear against the outer surface of pressure element 13, so that the material of plastic housing part 15 can be molded against pressure element 13 inside the injection mold.

In the exemplary embodiments of FIGS. 7 and 8, in particular, it is also conceivable that the material of plastic housing part 15 may not form a material-to-material bond with pressure element 13 during the molding of plastic housing part 15. Since body 130 of pressure element 13 is engaged in groove 102 of stem portion 101, pressure element 13 is held in position relative to plastic housing part 15, so that in this way a connection between plastic housing part 15 and pressure element 13 is created through areal engagement.

The concept underlying the invention is not limited to the above-described exemplary embodiments, but may also be implemented in a completely different way.

A connector of the type discussed herein may advantageously be configured as a circular connector. However, this is not mandatory. Generally, the invention can also be utilized in other connectors.

By using the pressure element, the sealing element is caused to compress, such compression reliably sealing a transition between the plastic housing part and shield sleeve. The compression of the sealing element is effected by the pressure element and is generally independent of the plastic housing part. Thus, the formation of the plastic housing part on the shield sleeve and the sealing are decoupled from each other, which, on the one hand, allows the plastic housing part to be formed on the shield sleeve in a convenient and easy manner and, on the other hand, provides for a reliable seal.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE CHARACTERS

1 connector part
10 shield sleeve

100 plug-in portion
101 stem portion
102 latching groove
11 threaded element
110 thread
111 collar
12 connector face
120 contact element
13 pressure element
130 body
131 engagement surface
132 receiving means
133 end face
14 sealing element
140 planar portion
141 bead portion
15 plastic housing part
150 end face
2 electrical cable
3 mating connector part
E plugging direction

The invention claimed is:

1. A connector part, comprising:
an electrically conductive shield sleeve;
a plug-in portion provided on the shield sleeve for plug-in connection to an associated mating connector part;
at least one electrical contact element disposed in or on the plug-in portion;
a plastic housing part at least partially enclosing the shield sleeve;
a pressure element which is disposed on the shield sleeve and connected to the plastic housing part and which has a receiving means; and
a sealing element which is disposed in the receiving means of the pressure element and in sealing engagement with the shield sleeve to seal a transition between the plastic housing part and the shield sleeve.

2. The connector part as recited in claim 1, wherein the plastic housing part is formed by overmolding a portion of the shield sleeve.

3. The connector part as recited in claim 1, wherein the plastic housing part is connected to the pressure element by a material-to-material bond.

4. The connector part as recited in claim 1, wherein the plastic housing part at least partially encloses the shield sleeve.

5. The connector part as recited in claim 1, wherein the shield sleeve has a latching groove in which the pressure element is engaged.

6. The connector part as recited in claim 1, wherein the sealing element is annular in shape.

7. The connector part as recited in claim 1, wherein the pressure element has a body and an engagement surface formed thereon, the pressure element being in engagement with the shield sleeve via the engagement surface.

8. The connector part as recited in claim 1, wherein the receiving means forms an undercut configured to receive the sealing element.

9. The connector part as recited in claim 1, wherein the sealing element is comprised of an element separate from the pressure element and is inserted in the receiving means of the pressure element.

10. The connector part as recited in claim 1, wherein the pressure element and the sealing element comprise plastic injection molded parts formed by a two-component injection molding technique.

11. The connector part as recited in claim 1, wherein the pressure element is comprised of a first plastic material and the sealing element is comprised of a second plastic material that is softer than the first plastic material.

12. The connector part as recited in claim 1, wherein the sealing element has a bead portion which is received in the receiving means of the pressure element.

13. A method for manufacturing the connector part according to claim 1,
placing the pressure element on the shield sleeve together with the sealing element; and
forming the plastic housing part on the shield sleeve by overmolding.

14. A connector part, comprising:
an electrically conductive shield sleeve;
a plug-in portion provided on the shield sleeve for plug-in connection to an associated mating connector part;
at least one electrical contact element disposed in or on the plug-in portion;
a plastic housing part at least partially enclosing the shield sleeve;
a pressure element which is disposed on the shield sleeve and connected to the plastic housing part and which has a receiving means; and
a sealing element which is disposed in the receiving means of the pressure element and in sealing engagement with the shield sleeve to seal a transition between the plastic housing part and the shield sleeve,
wherein the shield sleeve is formed at an end opposite the plug-in portion with a stem portion on which the plastic housing part is disposed.

15. The connector part as recited in claim 14, wherein the pressure element is annular in shape and disposed on the stem portion of the shield sleeve such that the pressure element extends around the stem portion.

16. A connector part, comprising:
an electrically conductive shield sleeve;
a plug-in portion provided on the shield sleeve for plug-in connection to an associated mating connector part;
at least one electrical contact element disposed in or on the plug-in portion;
a plastic housing part at least partially enclosing the shield sleeve;
a pressure element which is disposed on the shield sleeve and connected to the plastic housing part and which has a receiving means; and
a sealing element which is disposed in the receiving means of the pressure element and in sealing engagement with the shield sleeve to seal a transition between the plastic housing part and the shield sleeve,
wherein the sealing element has a bead portion which is received in the receiving means of the pressure element, and
wherein the sealing element has a planar portion that extends from the bead portion and bears against an end face of the pressure element.

* * * * *